US005867850A

United States Patent [19]

Mariol

[11] Patent Number: 5,867,850

[45] Date of Patent: Feb. 9, 1999

[54] BASSINET

[75] Inventor: John V. Mariol, Cincinnati, Ohio

[73] Assignee: Kolcraft Enterprises, Inc., Chicago, Ill.

[21] Appl. No.: 872,605

[22] Filed: Jun. 10, 1997

Related U.S. Application Data

[63] Continuation-in-part of Ser. No. 66,733, Feb. 20, 1997, and a continuation-in-part of Ser. No. 741,376, Oct. 30, 1996, Pat. No. 5,778,465.

[51] Int. Cl.[6] ..... A47D 7/04

[52] U.S. Cl. ..... 5/93.2; 5/98.1; 5/513

[58] Field of Search ..... 5/93.1, 93.2, 98.1, 5/99.1, 513

[56] References Cited

U.S. PATENT DOCUMENTS

| | | | |
|---|---|---|---|
| D. 366,978 | 2/1996 | Mariol | D6/491 |
| 961,669 | 6/1910 | Atkinson . | |
| 1,204,416 | 11/1916 | Doser . | |
| 2,553,087 | 5/1951 | Hanson | 5/93 |
| 2,688,997 | 9/1954 | Miller | 155/44 |
| 2,992,440 | 7/1961 | Revolt | 5/93.1 |
| 3,078,478 | 2/1963 | Sheahan | 5/93 |
| 3,574,872 | 4/1971 | Mattila | 5/94 |
| 3,644,947 | 2/1972 | Padera | 5/92 |
| 3,735,430 | 5/1973 | Platz | 5/118 |
| 4,073,017 | 2/1978 | Stevens | 5/97 |
| 4,433,447 | 2/1984 | Mathou | 5/93.1 |
| 4,750,223 | 6/1988 | D'Arcy et al. | 5/99 B |
| 4,890,341 | 1/1990 | Rist | 5/513 X |
| 4,967,432 | 11/1990 | Kujawski et al. | 5/98 |
| 4,999,863 | 3/1991 | Kane | 5/98.1 |
| 5,115,524 | 5/1992 | Antosko | 5/99.1 |
| 5,339,470 | 8/1994 | Shamie | 5/98.1 |
| 5,349,709 | 9/1994 | Cheng | 5/93.1 |
| 5,535,457 | 7/1996 | Welsh, Jr. et al. | 5/93.1 |
| 5,553,336 | 9/1996 | Mariol | 5/93.1 |
| 5,555,577 | 9/1996 | Volpe | 5/93.1 |
| 5,615,427 | 4/1997 | Huang | 5/99.1 |

OTHER PUBLICATIONS

"Evenflo" Play Yard with Bassinet Attached.

"Graco" Play Yard with Bassinet Attached.

*Primary Examiner*—Michael F. Trettel

*Attorney, Agent, or Firm*—Marshall, O'Toole, Gerstein, Murray & Borun

[57] ABSTRACT

A bassinet for a play yard having a bottom wall, a continuous upstanding side wall and one or more separating panels to divide the bassinet into discrete stand-alone compartments. A removable cover may be utilized with one or more compartments.

11 Claims, 2 Drawing Sheets

BASSINET

CROSS-REFERENCE TO RELATED APPLICATION

This application is a continuation-in-part application of still pending U.S. design patent application Ser. No. 29/066,733, filed Feb. 20, 1997, entitled "Bassinet," U.S. utility patent application Ser. No. 08/741,376, filed Oct. 30, 1996, entitled "Bassinet for Attachment to a Child's Playard. " now issued as U.S. Pat. No. 5,778,405

BACKGROUND OF THE INVENTION

The invention disclosed and claimed herein relates generally to a new and improved bassinet for a play yard or other device; and, more particularly, the invention relates to a bassinet having one or more storage compartments.

DESCRIPTION OF THE PRIOR ART

Play yards and cribs often are utilized with bassinets which are adapted to be disposed over or hang from the play yard or crib. While such bassinets are satisfactory for purposes of holding an infant while it is sleeping or while its diaper or clothes are changed, bassinets have not been entirely satisfactory. Play yards generally have a large surface area in which an infant is located as compared to the surface area for placing a baby in a bassinet. Further, prior art bassinets generally have one or more holding areas located about the peripheral area of the bassinet.

While such units hold various materials such as pins, diapers, bottles, etc., what is desired is a compartmentalized bassinet in which the bassinet is divided into discrete compartments having closure means therefor as well as an area upon which an infant can be laid while changing the infant's diapers, clothes, etc. It is desired to have the storage compartment be sizable, stand-alone units in that they do not collapse on materials stored in the storage unit and the storage unit is not accessible to an infant located in the sleeping or changing compartment. Moreover, it is desired to have a closure system whereby a compartment can be sealed off, but yet, readily opened to gain access to the materials stored within the unit. Finally, it is desired to place a bassinet on a play yard and have the bassinet compartmentalized to provide a surface area in which an infant can be placed which is approximately the same size surface area as presently available with conventional bassinets not used in association with play yards.

It is especially desired to have such a bassinet for use with a play yard having a triangular-shaped upper rail assembly as disclosed, for example, in pending application Ser. No. 29/066,733.

SUMMARY OF THE INVENTION

The invention disclosed and claimed herein serves to obviate the problems and concerns associated with bassinets presently available while at the same time achieving the desired features for a bassinet.

Briefly, the bassinet of the present invention is suited to be used in conjunction with a multi-sided play yard. The bassinet is adapted to be joined to the play yard with the play yard being compartmentalized with discrete stand-alone compartments. One of the compartments in which an infant is to be placed for diaper changing and the like preferably is designed to have a surface area on which the infant is located which corresponds to the surface area of a conventional bassinet. Additionally, the bassinet compartments are individually formed, stand-alone compartments and preferably of a height such that an infant disposed in one compartment cannot readily reach into another compartment. As a result, an infant can be placed in one area of the bassinet which is segmented from items stored in other stand-alone compartments.

Additionally, a cover is provided for the compartment which can be releasably opened or closed to permit access to the contents within a compartment.

DETAILED DESCRIPTION OF THE DRAWINGS

Figure 1:
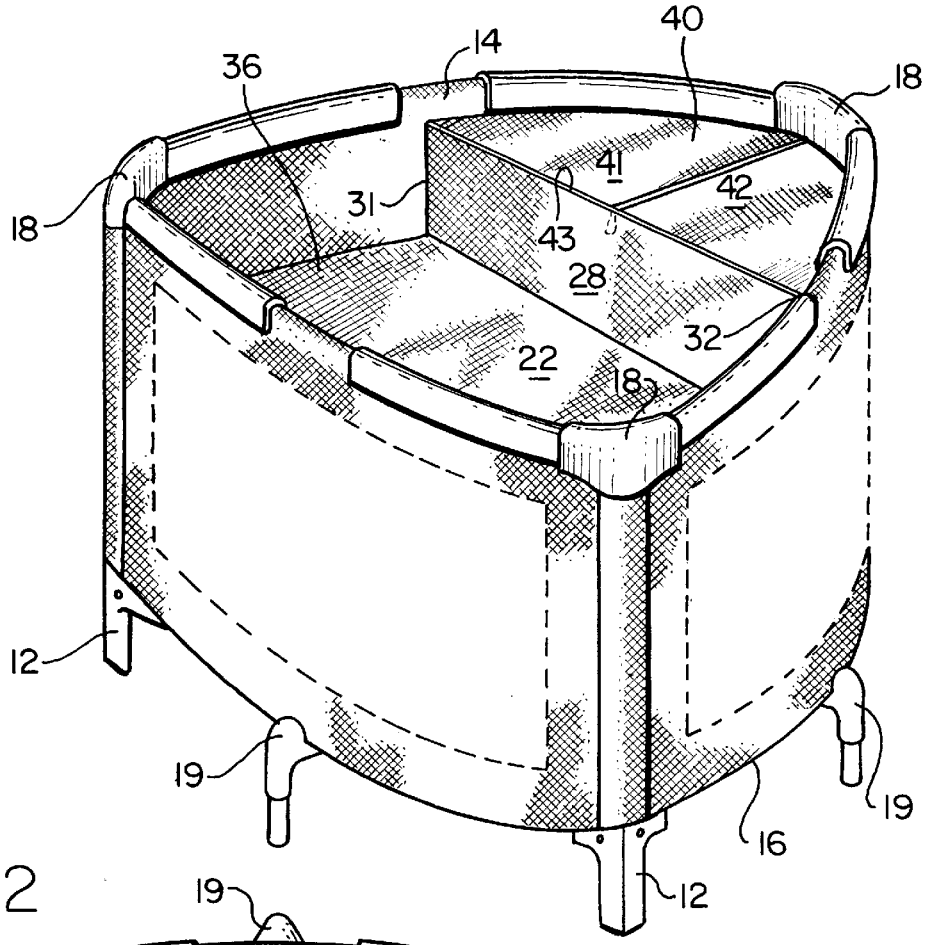
FIG. 1 shows a perspective view of a play yard having a bassinet releasably disposed on the top rail assembly of the play yard.

Referring to FIG. 1, there is shown a play yard 10 in an open position. Play yard 10 includes a plurality of spaced vertical posts 12. An upper triangular-shaped rail assembly 14 and a lower triangular-shaped bottom support assembly 16 are connected to posts 12 contiguous to the upper and lower post ends 18, 20. Panels 22 depend from top rail assembly 14 and connect to a bottom panel which extends across the top of lower support assembly 16 when the play yard is in an open position. Stabilizer feet 19 are attached to the lower support member and are positioned mediate adjacent vertical posts 12. The stabilizer feet and posts serve to maintain the play yard in a stable position.

Bassinet 20 is disposed within play yard 10. Bassinet 20 includes a triangular-shaped bottom panel 22 and a continuous side wall 23 having a top edge 24 and bottom edge 25. Side wall 23 extends about the periphery of bottom panel 22 and is joined to the peripheral edge of panel 22 at side wall bottom edge 25.

A plurality of spaced plastic hanger members 26 are attached to side wall 23 and extend outwardly from top side wall edge 24. The hangers preferably are fastened to the side wall edge as disclosed in pending U.S. patent application Ser. No. 08/741,376, filed Oct. 30, 1996, the disclosure of which is incorporated herein.

Figure 2:
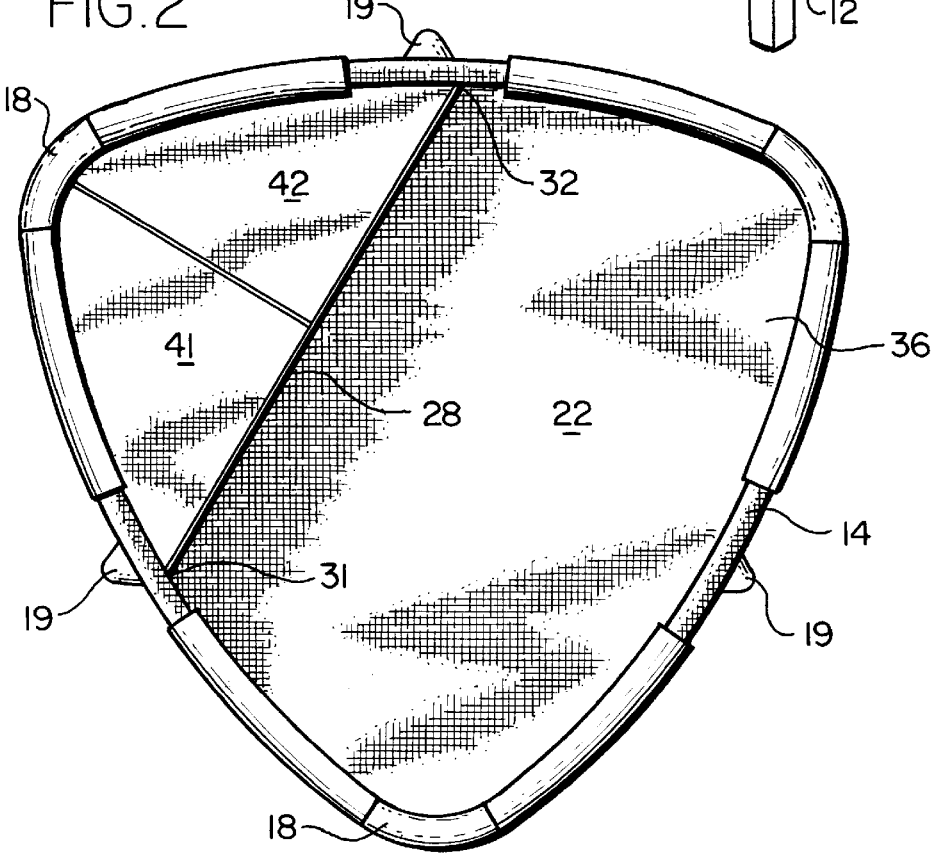
FIG. 2 shows a plan view of the bassinet of FIG. 1.
Figure 3:
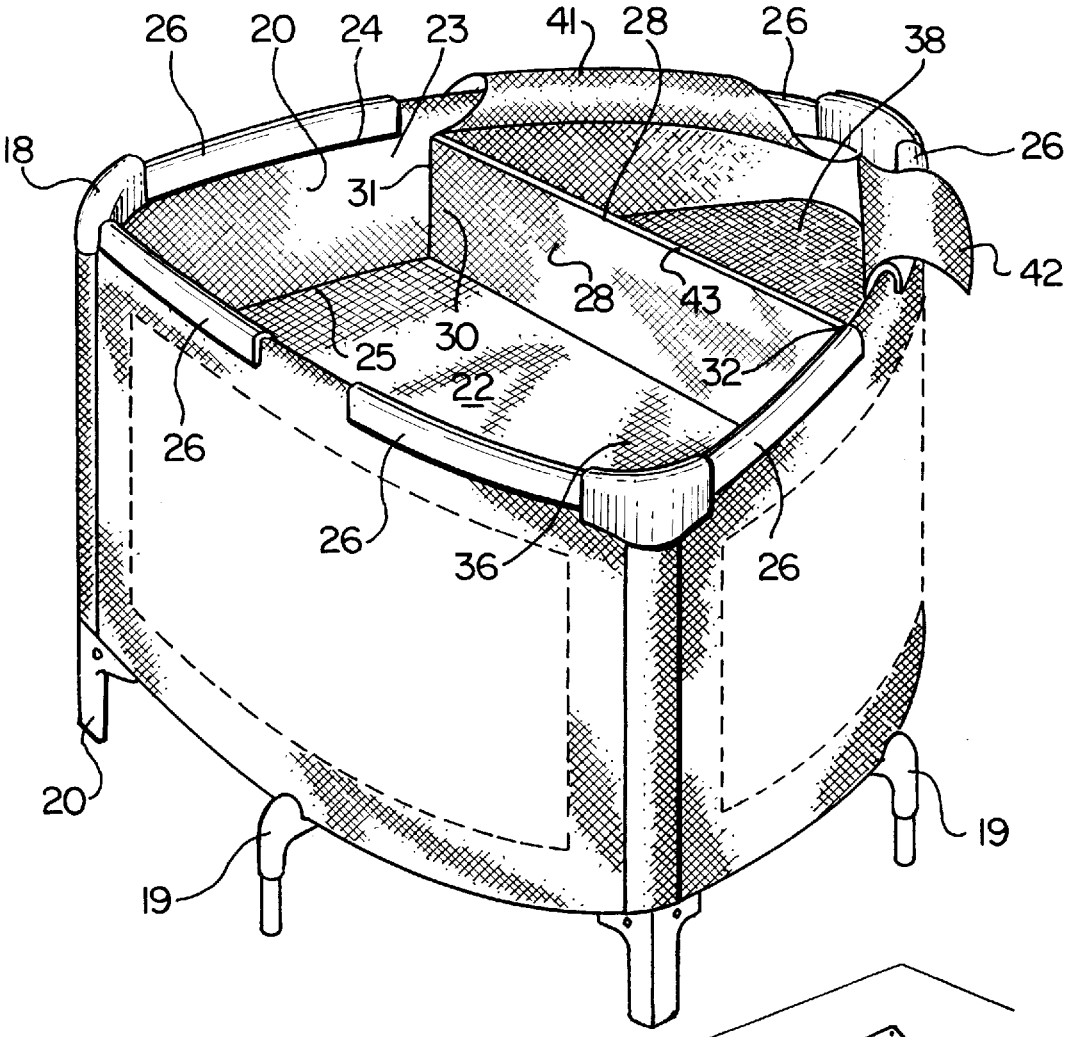
FIG. 3 shows a perspective view of the bassinet of FIG. 1 with-the cover of the stand-alone storage compartment opened to allow access to materials dispose within the compartment; and, FIG. 4 shows a fragmentary, partial perspective view of a closure system for releasably opening and closing the bassinet storage compartment.
Figure 4:
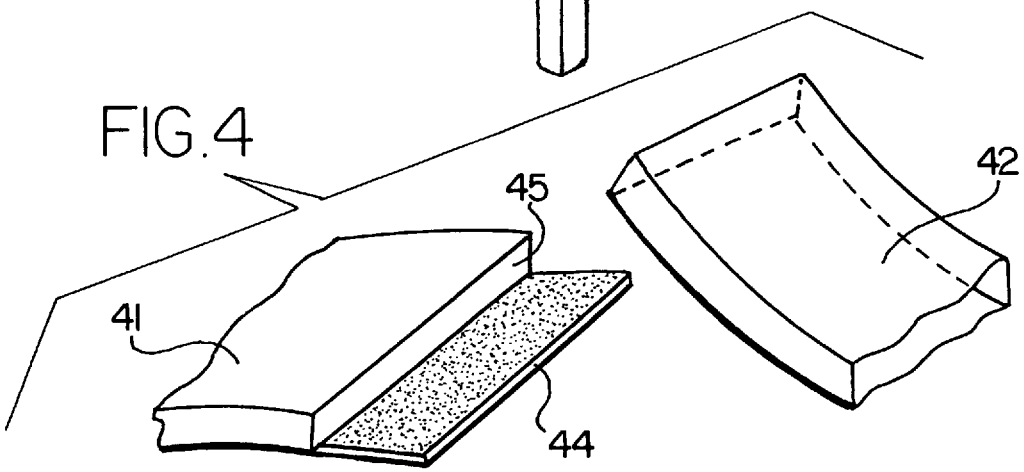

A relatively stiff panel 28 is disposed within bassinet 10, panel 28 having a rectangular shape and a length 29 substantially greater than its width 30. Panel 28 has two ends 31, 32, each panel end being fastened to side wall 23 along the width of the respective panel ends. Panel 28 can be made of a flexible, relatively stiff cardboard or polymeric material suitably by a cloth or plastic material, as seen in FIGS. 1 and 2. Panel 28 provides a substantially stiff, upstanding wall in the bassinet thereby forming discrete stand-alone compartments 36, 38. Preferably, the panels 38 will be of a height to assure that access to a storage compartment 38 is not readily available to an infant disposed in compartment 36. Further, the surface area formed in compartment 36 in which an infant normally would be disposed preferably is designed to have approximately the surface area of a conventional bassinet. Of course, if one desired, a larger or smaller surface area for compartment 36 can be achieved depending upon the placement of panel 28.

A flexible cover 40 is disposed over compartment 38. Cover 40 includes cover sections 41, 42. Each section preferably is releasably fastened to top edge 43 of panel 28 and to one another at tab 44 extending out from and located along edge 45 of section 41. Velcro is disposed on tab 44, the velcro being adapted to contact section 42 releasably holding the section 41 to section 42. Further, velcro may be, if desired, disposed along panel edge 43 for the purpose of contacting sections 41, 42 to releasably, positively fasten sections 41, 42 to panel 28.

It is appreciated that, if desired, rather than utilizing a velcro-type release system, the sections could be joined to each other and/or panel 28 by any conventional fastening system such as a zipper, button, hook, or snap-on system.

Further, it is appreciated that, while the bassinet has been formed into two discrete, stand-alone compartments, additional compartments could be created by the use of additional panels. As noted, panel 28 can be fabricated from any suitable material such as plastic or wood pulp material. It is desired that it be relatively rigid to maintain a compartment in a stand-alone position whereby the compartment will not collapse during normal use of the bassinet.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. A bassinet for use in a play yard, said bassinet comprising:

a bottom wall;

a side wall extending along the periphery of said bottom wall;

a panel extending upward from said bottom wall and separating said bassinet into at least two separate discrete stand-alone compartments;

cover sections attached to said bassinet and associated with one of said compartments; and, means for releasably securing said cover sections together to form a closed compartment with said one of said discrete compartments.

2. A bassinet in accordance with claim 1 wherein said securing means further includes means for releasably fastening at least one of said cover sections to said panel.

3. A bassinet in accordance with claim 1 and further including substantially rigid hangers attached to said bassinet side wall and projecting outwardly away from said bassinet side wall.

4. A bassinet in accordance with claim 1 wherein said bottom panel has a triangular-shape and said bassinet is triangularly shaped and adapted to be disposed in a triangular-shaped play yard rail assembly.

5. A bassinet for use in a play yard, said bassinet comprising:

a bottom wall;

a side wall extending along the periphery of said bottom wall;

a panel extending upward from said bottom wall and separating said bassinet into at least two separate compartments;

a cover secured to said bassinet; and, means for releasably securing said cover to said panel to form a closed compartment with one of said discrete compartments.

6. A bassinet in accordance with claim 5 wherein the cover is secured to said side wall.

7. A bassinet in accordance with claim 5 and further including substantially rigid hangers attached to said bassinet side wall and projecting outwardly away from said bassinet side wall.

8. A bassinet in accordance with claim wherein said bottom panel has a triangular-shape and said bassinet is triangularly shaped and adapted to be disposed in a triangular-shaped play yard rail assembly.

9. A bassinet for use in a play yard, said bassinet comprising:

a bassinet bottom wall;

a side wall integral with and extending along the periphery of said bassinet bottom wall;

a substantially rigid panel integral with said bassinet bottom and side wall and extending upward from said bassinet bottom wall separating said bassinet into at least two separate discrete stand-alone compartments whereby said bassinet and compartments comprise one integral unit; and, attaching members disposed on said bassinet for attaching said bassinet to a play yard having a play yard bottom wall whereby said bassinet bottom wall is suspended above said play yard bottom wall.

10. A bassinet as recited in claim 9 wherein the panel has a height such that an infant disposed in a first one of the compartments cannot reach into a second one of the compartments.

11. A bassinet as recited in claim 9 and including a cover adapted to be disposed over at least one of said compartments.

* * * * *

UNITED STATES PATENT AND TRADEMARK OFFICE

CERTIFICATE OF CORRECTION

PATENT NO. : 5,867,850

DATED : February 9, 1999

INVENTOR(S) : John V. MARIOL

It is certified that error appears in the above-identified patent and that said Letters Patent is hereby corrected as shown below:

| | |
|---|---|
| Column 4, line 24 | after "...in accordance with claim", please insert -- 5 --. |

Signed and Sealed this

Sixth Day of July, 1999

*Attest:*

Q. TODD DICKINSON

*Attesting Officer*

*Acting Commissioner of Patents and Trademarks*